United States Patent [19]

Allan

[11] 4,373,314

[45] Feb. 15, 1983

[54] MASONRY VENEER WALL ANCHOR

[75] Inventor: Jack A. Allan, Palos Hills, Ill.

[73] Assignee: AA Wire Products Company, Chicago, Ill.

[21] Appl. No.: 329,243

[22] Filed: Dec. 10, 1981

[51] Int. Cl.[3] ..... E04B 1/41

[52] U.S. Cl. ..... 52/434; 52/714; 52/379

[58] Field of Search ..... 52/434, 379, 573, 712, 52/713, 714, 562, 255

[56] References Cited

U.S. PATENT DOCUMENTS

| | | | |
|---|---|---|---|
| 814,134 | 3/1906 | Hood . | |
| 819,869 | 5/1906 | Dunlap . | |
| 1,708,696 | 4/1929 | Hellerman . | |
| 1,794,684 | 3/1931 | Handel . | |
| 1,846,633 | 4/1932 | Stephens . | |
| 3,255,561 | 6/1966 | Cable | 52/714 X |
| 3,341,998 | 9/1967 | Lucas | 52/379 |
| 3,350,831 | 11/1967 | Miller | 52/573 |
| 3,377,764 | 4/1968 | Storch | 52/713 |
| 3,568,389 | 3/1971 | Gulow | 52/714 |
| 4,021,990 | 5/1977 | Schwalberg | 52/714 |
| 4,324,079 | 4/1982 | Pearson | 52/712 X |

FOREIGN PATENT DOCUMENTS 2069024 8/1981 United Kingdom ..... 52/714

OTHER PUBLICATIONS

AA Wire Products Company, "1977 Guide to Masonry Reinforcing Systems and Ties", 1976, cover page and pp. 10–12.

AA Wire Products Company, "AA Adjustable Veneer Anchors", advertising flier.

AA Wire Products Company, "AA Adjustable Veneer Ties", advertising flier.

*Primary Examiner*—J. Karl Bell

*Attorney, Agent, or Firm*—Hill, Van Santen, Steadman, Chiara & Simpson

[57] ABSTRACT

A masonry veneer wall anchor formed of an integral metal form preformed as an L-shaped bar has one leg overlying a building frame member for attachment thereto and has an outstanding leg with slotted holes formed therein in selected spaced relation through which a tying member may be inserted for vertical adjustment, the tying member engaging the edges of the slot to provide improved resistance to compressive as well as pulling forces, thereby maximizing functional effectiveness.

9 Claims, 8 Drawing Figures

MASONRY VENEER WALL ANCHOR

BACKGROUND OF THE INVENTION

1. Field of the Invention

This invention relates to an anchor for tying a masonry veneer wall to the framing of an architectural structure.

2. Description of the Prior Art

With modern construction techniques, it is a common practice to enclose the framing of a building with a masonry veneer wall.

Many architects and engineers firmly believe that masonry wall cracking would be reduced to a minimum if walls were permitted more freedom of movement. Accordingly, systems have been heretofore designed to provide lateral restraint while permitting horizontal and vertical movement.

In one form of such system heretofore manufactured and sold by the applicant's assignee, AA Wire Products Company of Chicago, Ill., a flexible tie for tying masonry walls to concrete or to steel is provided which is sold under the trademark "DOVETAIL FLEX-O-LOK" (to concrete) and "FLEX-O-LOK" (to steel). Examples of such ties include a masonry wall laterally tied to concrete or steel columns, or masonry walls laterally tied to concrete or steel beams, or precast concrete panels or stone laterally tied to poured concrete or steel back-up. In such an arrangement, a wire form or flat steel form of anchor is fastened either to an intervening flat plate or directly to an architectural structure as a matter of customer choice, whereupon a tying member adjustably moves relative to the anchor and is inserted between courses of the adjoining veneer wall, thereby to permit the desired flexibility.

The prior art is also exemplified by the Schwalberg U.S. Pat. No. 4,021,990 issued May 10, 1977 wherein a veneer anchor comprises a plate member having a vertically projecting bar portion secured thereto and disposed in substantially parallel relationship with the plate member. The anchor is employed to secure a wallboard to a vertical channel or standard framing member. Thereafter, a mason inserts a wall tie between the plate member and projecting bar portion and the wall tie is built into the outer wythe of the wall system. Since the wall tie is capable of vertical movement, vertical adjustability is effected.

To ensure structural stability and to resist lateral pressure, such as that resulting from wind forces, it is necessary to tie the masonry veneer wall to the framing. Furthermore, it is often desirable to maintain a gap between the framing and veneer wall for ventilation and drainage purposes or to accommodate a layer of insulating material.

The prior art structures do not accomplish such objectives with full effectiveness.

SUMMARY OF THE INVENTION

According to the present invention, an anchor is formed of an integral metal form which is preformed as an L-shaped bar such as an angle iron. The outstanding leg of the anchor has one or more slotted holes formed therein in a selected spaced relation depending on the end use. The leg overlying the building frame member is provided with holes through which fasteners, such as screws or nails, are inserted for securing the anchor to either metal or wood studs.

The depth of the outstanding leg and the spacing of the slotted openings is selectively varied to allow a desired thickness of insulating material to be placed in the gap between the framing and the veneer wall. The relative thinness of the outstanding anchor leg allows adjacent pieces of insulating material to be placed within close proximity of one another, thus minimizing energy-losing holes in the insulation.

A wire tie is inserted through one of the slotted holes in the anchor and is vertically adjustable to be embedded in a horizontal masonry joint. The wire may bear against the perimeter of the slotted hole. By virtue of such provision the present invention provides improved resistance to compressive as well as axial forces, thereby maximizing its functional effectiveness.

DESCRIPTION OF THE PREFERRED EMBODIMENT

Figure 1:
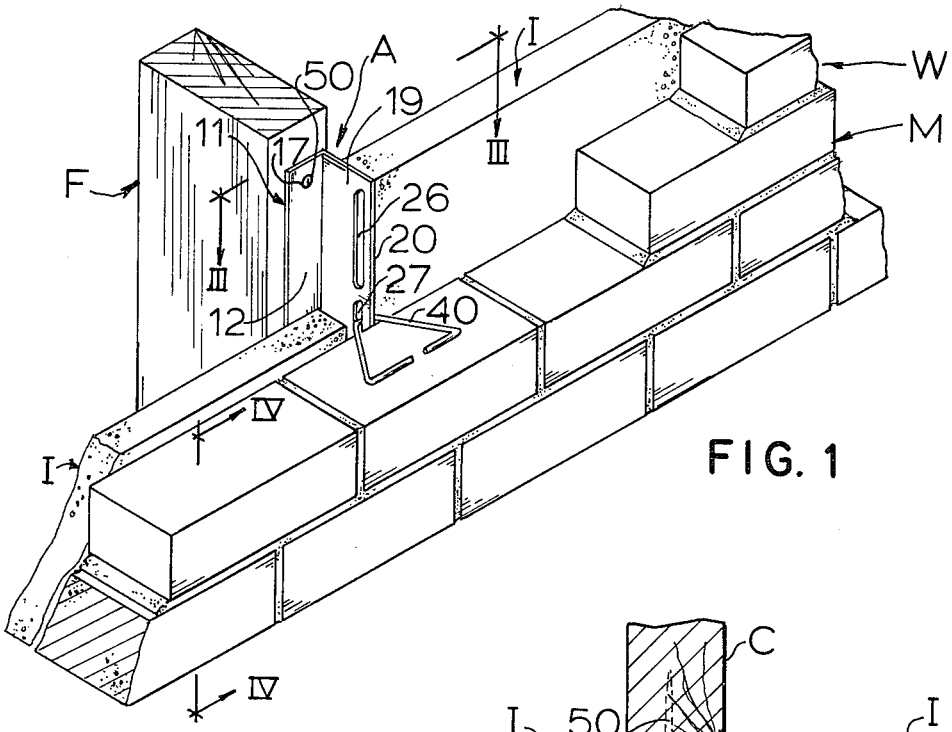
FIG. 1 is a fragmentary perspective view of a masonry veneer wall construction incorporating a wall with insulation and embodying the principles of the invention.

As shown in FIG. 1, an insulated wall construction denoted generally at W, comprises a masonry veneer M, wood stud framing F, and a layer of insulation I. A wall anchoring means for tying the masonry veneer to the framing F embodying the principles of the present invention is shown generally at A.

Figure 2:
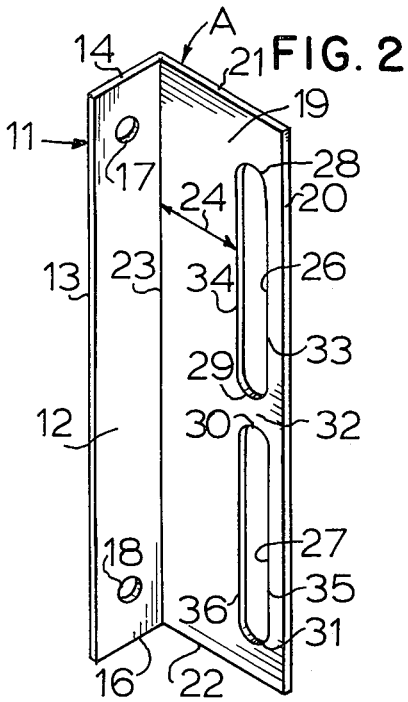
FIG. 2 is a perspective view of the wall anchor used in the environment of FIG. 1.

According to the invention, the anchoring means A comprises a metallic member shaped as a prefabricated metal form, for example, an L-shaped metallic bar, with two legs perpendicularly offset with respect to one another comparable to an angle iron. Thus, as best shown in FIG. 2, there is provided a first leg 12 having a longitudinal edge 13 and opposite end edges 14 and 16. The leg 12 is intended to lie against a corresponding framing member, whether that framing member be wood, steel or concrete. In order to affix the leg 12 to an adjoining surface of a framing member, there is provided a pair of spaced through holes 17 and 18 located inwardly of the end edges 14 and 16, respectively.

A second leg 19 is offset perpendicularly with respect to the leg 12 and is provided with a longitudinal edge 20 and opposite end edges 21 and 22.

In the form of the invention illustrated in FIG. 1, the leg 19 of the anchoring means A is selected to be of a length sufficient to extend completely through the insulation I and to locate the edge 20 adjacent the inner surface of the veneer M.

It is contemplated by the present invention that there be provided in the leg 19 one or more elongated recesses or openings to accommodate an adjustable tie. Accordingly, there is shown in the drawings, by way of example, two separate slots or elongated openings which are indicated at 26 and 27, respectively, the slots 26 and 27 being located inwardly of the edge 20 and bounded longitudinally by ends 28 and 29 and laterally by sides 33 and 34 with respect to the slot 26, and bounded by the ends 30 and 31 and the sides 35 and 36 with respect to the slot 27. The extreme ends 28 and 31 are inwardly of the edges 21 and 22, respectively, and the inner ends 29 and 30 are spaced from one another and separated by a continuous web portion of the leg 19 shown specifically at 32. In practical effect, therefore, the limits of adjustability are prescribed by the ends of the two slots, namely, the extreme ends 28 and 31. Preferably, the slots 26 and 27 are arranged in a coaxial disposition with respect to one another, although it is conceivable that the slots could be located on different axes and the anchor would still be functional. Generally, the slots are disposed in parallelism to the main longitudinal axis of the anchor.

With respect to the anchoring means A, as shown in FIGS. 1–4, it will be apparent that the slots 26 and 27 are located inwardly of the edge 20 but are spaced so that the slots will extend outwardly of the insulation I, permitting ready access to slots 26 and 27 for accommodation of a tie member designed to provide lateral restraint while permitting horizontal and vertical movement.

It is contemplated by the present invention that the depth of the leg 19 be selectively varied so that the anchoring means A could be provided in specifically selected sizes for different end use applications. Thus, the selectively variable dimension would be the dimension between the corner joint 23 and the slot inner sides 34 and 36 which dimension is shown in FIG. 2 at 24. As an example of how the width of the outstanding leg 19 may be selected to accommodate intervening layers of insulating material of various thicknesses, it may be noted that to accommodate a one inch (25.4 mm) thick insulation layer, the dimension 24 may be set at $1\frac{1}{8}$ inch (28.6 mm). To accommodate a two inch (50.8 mm) thick insulation layer, the dimension 24 may be set at $2\frac{1}{8}$ inch (54.0 mm).

In order to effect flexible anchorage and wall clamping, ties shown generally at 40 are provided which may conveniently be formed in varied sizes. For example, 3/16" mill galvanized wire is provided in a truncated triangular configuration. Nos. 9 or 6 gauge or $\frac{1}{4}$" is also selectively available.

Figure 3:
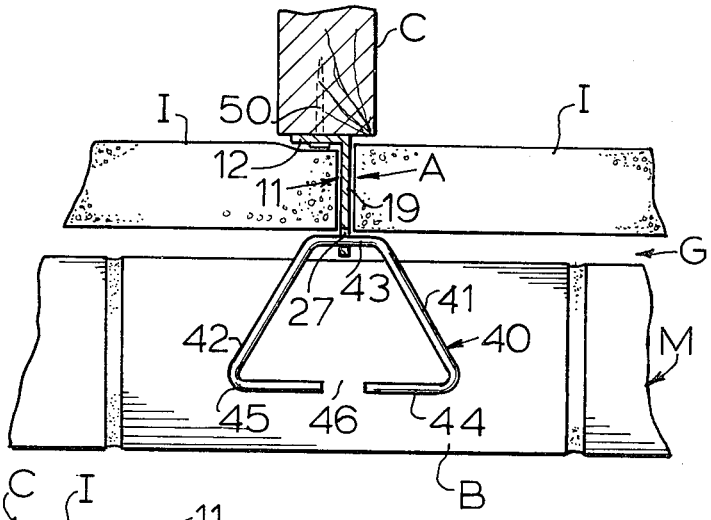
FIG. 3 is a top plan view taken along the line III—III of FIG. 1.

As best shown in FIG. 3, the wire form tie member has angled side legs 41 and 42 meeting at an apical portion truncated to form an end leg 43. There are two base legs 44 and 45 separated by a gap 46 to permit the tie 40 to be inserted into the slots of the anchor. The ties vary from 3" to 9" in depth to accommodate veneer walls of different thickness.

Layers of insulating material I are interposed between the veneer wall and the framing C. The pieces of insulating material may be brought together so that they are separated only by the thickness of the outstanding leg 19 of the anchor A. If the edges of the insulation are notched to fit around the outstanding leg 19, the insulation may be abutted. With either approach, minimal energy losing air gaps in the insulation may be achieved.

The end leg side 43 of the tie 40 serves to confine the insulating material I and maintain an air gap G between the masonry veneer M and the insulation I.

Figure 4:
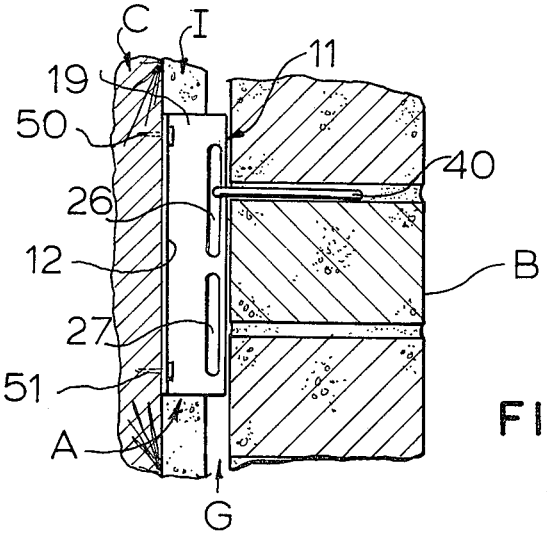
FIG. 4 is a side sectional view taken along the line IV—IV of FIG. 1.

As best seen on FIG. 4, the length of a slotted hole, or, as in this exemplary embodiment, the combined lengths of the slotted holes 26 and 27 should be somewhat greater than the thickness of a course of brick or block B. This will provide an adequate range of vertical adjustment of the tie 40 so that the tie 40 may rest atop a brick or block B regardless of the placement of the anchor A along the stud C.

It is also possible to apply the anchor of the invention in a wall construction incorporating a layer of wallboard. The wallboard may be interposed between the stud C and the anchor A with fasteners such as nails 50 and 51 driven through the holes 17 and 18 and wallboard into the stud C.

In the form of the invention shown in FIGS. 5 through 8, the anchor A is connected to a metal stud D and is used to lock a veneer M without an insulation layer. Thus, the leg **19*a*** is provided with a structural configuration of comparable characteristics each denoted by a comparable reference numeral, but with a suffix "a".

The slot or slots **26*a* and 27*a***, are in effect, located at a lesser depth since the insulation layer need not be accommodated.

Figure 5:
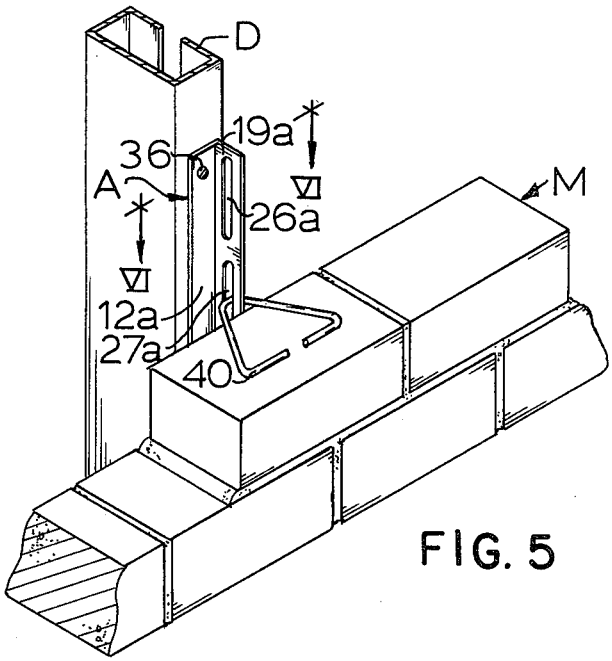
FIG. 5 is a perspective fragmentary view of a masonry veneer wall construction wherein the wall anchor of the present invention is used with a different form of wall construction utilizing metal studs and no insulation.

Referring to FIG. 5, the anchoring means of the invention is shown as incorporated in a non-insulated wall construction. The anchoring means A is similar in all respects to the embodiment shown in FIGS. 1 through 4, except that the width or depth or the outstanding leg **19*a*** is smaller or shallower. This embodiment is suitable for use in wall constructions where no layer of insulation or other material is desired between the stud D and the masonry M.

Figure 6:
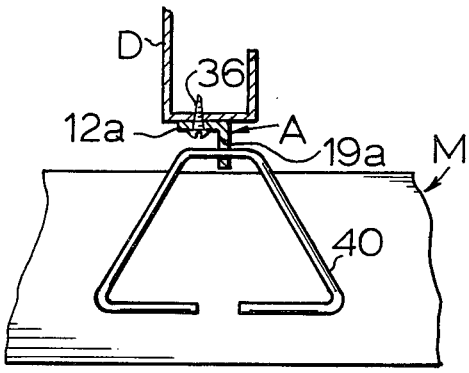
FIG. 6 is a top view taken along the line VI—VI of FIG. 5.

This embodiment of the anchor A is shown in FIG. 5 as being used with a metal stud D. As best seen in FIG. 6, the anchor may be attached to the stud D by a fastener such as a rivet or a sheet metal screw 36.

Figure 7:
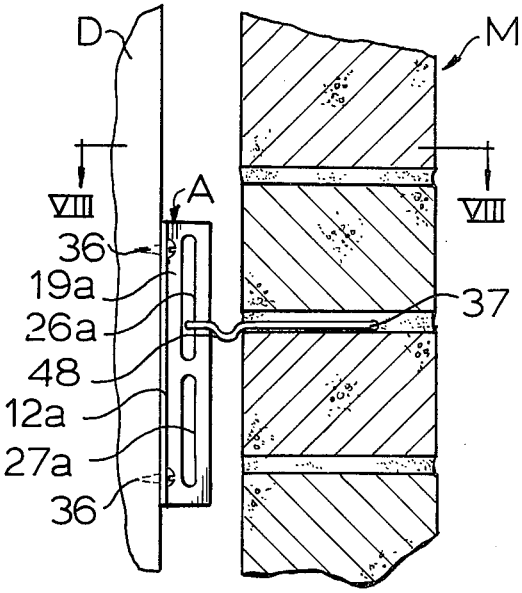
FIG. 7 is a side sectional view of a masonry veneer wall construction incorporating the anchor of the invention as used with a so-called weeper tie.
Figure 8:
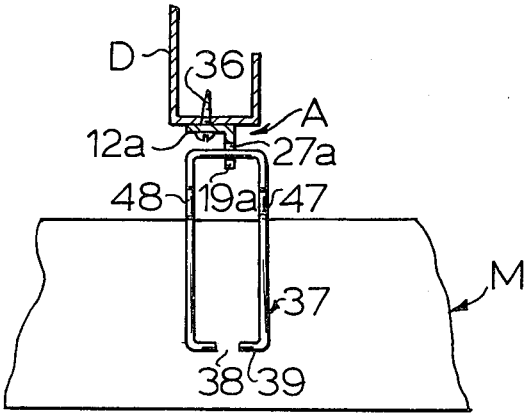
FIG. 8 is a top sectional view taken along the line VIII—VIII of FIG. 7.

In the form of the invention shown in FIGS. 7 and 8, the anchor A is connected to a stud D or a wall and is used to lock a veneer M by means of a so-called weeper tie. The tie 37 is formed of a bent wire and is generally rectangular having a gap 38 in one of the shorter sides 39. There are two downward bends 47 and 48 formed in the longer sides of the tie 37 intended to cause accumulated moisture to fall within the air space between the masonry D thus preventing wetting of wall surfaces.

It should be appreciated that alternative designs of ties such as tie 37 and 40 may be used interchangeably with the various embodiments of the anchor of the invention, such as the anchors shown in FIGS. 1 through 4 and in FIGS. 5 through 8.

It may be seen that compressive forces against the wall will be transmitted by the wire tie to an inner edge 34 or 36 (as shown in FIG. 2) of the slots 26 or 27 and then through the outstanding leg 19 ultimately distributing the load to the framing over the entire area of the overlying leg 12. Thus, both pushing and pulling forces such as those developed by wind pressures are effectively resisted.

As is now apparent, a new and useful masonry veneer wall anchor is provided, capable of accommodating a layer of insulating material and resisting pulling or pushing forces.

Although modifications might be suggested by those skilled in the art, it will be understood that I wish to embody within the scope of the patent described herein all such modifications as reasonably and properly come within the scope of my contribution to the art.

I claim as my invention:

1. For use in a masonry wall veneer tie construction, a unitary wall anchor comprising, first and second integrated rectangularly shaped leg components or coextensive length, each having ends spaced apart from one another in the direction of a vertical axis and each having a first longitudinal edge which is common to both thereby to form a corner joint, and each having a second longitudinal edge which is spaced from said first edge and disposed in respective offset planes intersecting at said corner joint, said first leg component having means for fastening said anchor with said first leg component in overlying relation to an adjoining architectural member, said second leg component having elongated slot means formed therein inwardly of its edges and bounded longitudinally by ends and bounded laterally by inner and outer sides extending in parallelism to said vertical axis, said slot means being sized to receive a tie means inserted therein in vertical sliding adjustment, the respective inner and outer sides of said slot means being engageable with the tie means for transmitting both pulling and pushing forces to the adjoining architectural member over the entire area of said overlying first leg component.

2. The invention as defined in claim 1 wherein said offset planes are disposed in a 90° offset relation with respect to one another.

3. The invention as defined in claim 1 wherein said slot means comprise two coaxial slots separated by an integral web.

4. The invention as defined in claim 2 and further characterized by the inner sides of said slot means being spaced a predetermined selected distance from said first leg component to accommodate layered insulation material interposed between the masonry veneer wall and the architectural member.

5. The device according to claim 1 wherein the width of said second leg component is selectable to accommodate layers of insulation material interposed between said frame member and said masonry veneer wall.

6. The device according to claim 1 and a tie means inserted in said slot means comprising a wire bent in a substantially trapezoidal shape having a gap formed in the longer parallel side thereof.

7. The device according to claim 1, and a tie means inserted in said slot means comprising a weeper tie having a wire bent in a substantially rectangular shape having a gap formed in one side thereof and having two downward bends in the sides adjacent said side with said gap for the accumulation and dripping of moisture.

8. The anchor of claim 1, wherein said slot means comprises one or more longitudinal slots.

9. The device according to claim 1, wherein the width of said second leg component is selectable to accommodate layers of insulation material interposed between the architectural member and the masonry wall veneer and the spacing of the slot means in said second leg component is selectively varied to allow a desired thickness of insulating material to be placed in the gap between the architectural member and the wall veneer.

* * * * *